United States Patent [19]

Henriquez

[11] Patent Number: 5,022,537

[45] Date of Patent: Jun. 11, 1991

[54] BIN LOCKING SYSTEM

[76] Inventor: Kenneth R. Henriquez, 4924 N. Chariton Ave., Tampa, Fla. 33603

[21] Appl. No.: 399,014

[22] Filed: Aug. 28, 1989

[51] Int. Cl.[5] ..... A47F 5/00

[52] U.S. Cl. ..... 211/88; 211/126; 312/245

[58] Field of Search ..... 211/88, 87, 126; 312/245; 248/220.2, 225.2

[56] References Cited

U.S. PATENT DOCUMENTS

| | | | |
|---|---|---|---|
| 1,887,159 | 11/1932 | Knight | 248/225.2 X |
| 3,791,528 | 2/1974 | Brendgord | 211/88 |
| 4,586,618 | 5/1986 | Norman | 211/88 X |
| 4,693,381 | 9/1987 | Lodge | 248/220.2 X |
| 4,889,377 | 12/1989 | Hughes | 211/88 X |
| 4,898,284 | 2/1990 | Arens | 211/88 X |

*Primary Examiner*—Robert W. Gibson, Jr.

*Attorney, Agent, or Firm*—A. W. Fisher, III

[57] ABSTRACT

A bin lock system to detachably mount at least one storage bin on a storage panel wherein the storage bin includes a flexible attachment member affixed to the rear portion thereof and the storage panel includes a bin receiving member and bin retaining member disposed in spaced relationship relative to each other such that when at least a portion of the flexible attachment member is mounted on the bin receiving member the bin retaining member is disposed to selectively engage the storage bin to secure the storage bin to the storage panel.

12 Claims, 2 Drawing Sheets

BIN LOCKING SYSTEM

BACKGROUND OF THE INVENTION

1. Field of the Invention

A bin lock system to detachable mount at least one storage bin to a storage panel.

2. Description of the Prior Ar

Numerous storage devices comprising a storage panel configured to support a plurality of storage bins thereon have been developed. Such storage devices designed for use in vehicles often comprise a stationary support frame secured to the interior of the van having a storage carriage slidably mounted thereon.

U.S. Pat. No. 4,705,315 discloses a slidable storage container mounted on an extension track which permits an operator to extract the storage container through the open cargo doors so that the storage container is easily accessible.

U.S. Pat. No. 3,360,136 shows a display panel frame including an upper and lower horizontal track having a series of vertically positioned, rectangular frames slidable mounted thereon.

U.S. Pat. No. 3,468,509 relates to a track mounting bracket having mounting tracks formed thereon to slidably support doors depending therefrom.

U.S. Pat. No. 4,305,695 discloses a slide or rollout tray including an array of castors between the deck and the tray to provide a slideout feature.

Various means have been designed to attach or secure storage bins to such panels or other support structures. Often pins and wire devices are used to secure the storage bins in place. Unfortunately such devices are prone to work loose becoming a dangerous projectile.

U.S. Pat. No. 3,698,565 teaches a panel section having a continuous longitudinally extending horizontal male connecting member and continuous longitudinally extending horizontal female connecting member. The panel sections are connected along adjacent upper and lower longitudinal edges by the mating of the male and femie connecting members to interlock the panel sections into a support panel for receiving the hooked ends of fasteners on the merchandise or the like to be displayed thereon.

U.S. Pat. No. 4,586,618 shows a storage/display system for storing and displaying goods including a grate attached to a frame having a display board attached thereto and containers or hooks connected to the grate to allow the goods to be displayed or stored.

U.S. Pat. No. 4,131,203 discloses a modular unit for mounting on vertical surfaces such as walls mounted by engaging a tongue in an upwardly opening channel.

U.S. Pat. No. 3,791,528 teaches an enclosure for handling, storing, transporting and distributing articles throughout a modular system with a self-seating and stabilizing interconnecting means for suspending the enclosure on an upright support.

U.S. Pat. No. 2,347,035 shows a key rack comprising a plate having a plurality of key supports, each including a pair of tongues spaced apart laterally and symmetrically inclined to converge downward toward a vertical line bent to form shanks extending approximately at right angles to the plate.

SUMMARY OF THE INVENTION

The present invention relates to a bin lock system to detachably mount a plurality of storage bins on a storage panel.

Each storage bin includes a flexible attachment member comprising a substantially vertical attachment element held in spaced relationship relative to the rear wall of the storage bin by a substantially horizontal spacer.

The storage panel comprises a substantially flat storage panel member having a plurality of pairs of bin receiving members and a corresponding plurality of bin retaining members formed thereon. Each bin receiving member comprises a substantially vertical receiving element held in spaced relationship relative to the substantially flat storage panel member by a substantially horizontal spacer to cooperatively form a retainer groove therebetween to receive a portion of the flexible attachment member. Each bin retaining member comprises a convex bin retaining element including a line of contact formed thereon to secure the storage bin to the storage panel.

The vertical distance between the retaining surface and the top or upper surface of the substantially vertical receiving element is less than the length of the substantially vertical attachment element such that the lower portion thereof remains disposed within the retainer groove even when the storage bin is in the uppermost position. In addition, the width of the substantially vertical attachment element of the storage bin is greater than the horizontal distance between the inside surface of the substantially vertical receiving element and apex of the bin retaining member such that the substantially vertical attachment element engages the line of contact when the storage bin is in the uppermost position to limit the upward movement of the storage bin.

In use, the substantially vertical attachment element is flexed between a pair of the bin receiving members and the corresponding bin retaining member such that the substantially vertical attachment element is disposed within the retainer groove. Movement of the storage bin relative to the storage panel is limited by the engagement of the flexible attachment member and the bin retaining member to retain the substantially vertical attachment element with the retainer groove to detachably secure the storage bin on the storage panel. The storage bin may be removed from the storage panel by flexing the substantially vertical attachment element and lifting the storage bin upward relative to the storage panel removing the substantially vertical attachment element from the retainer groove.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
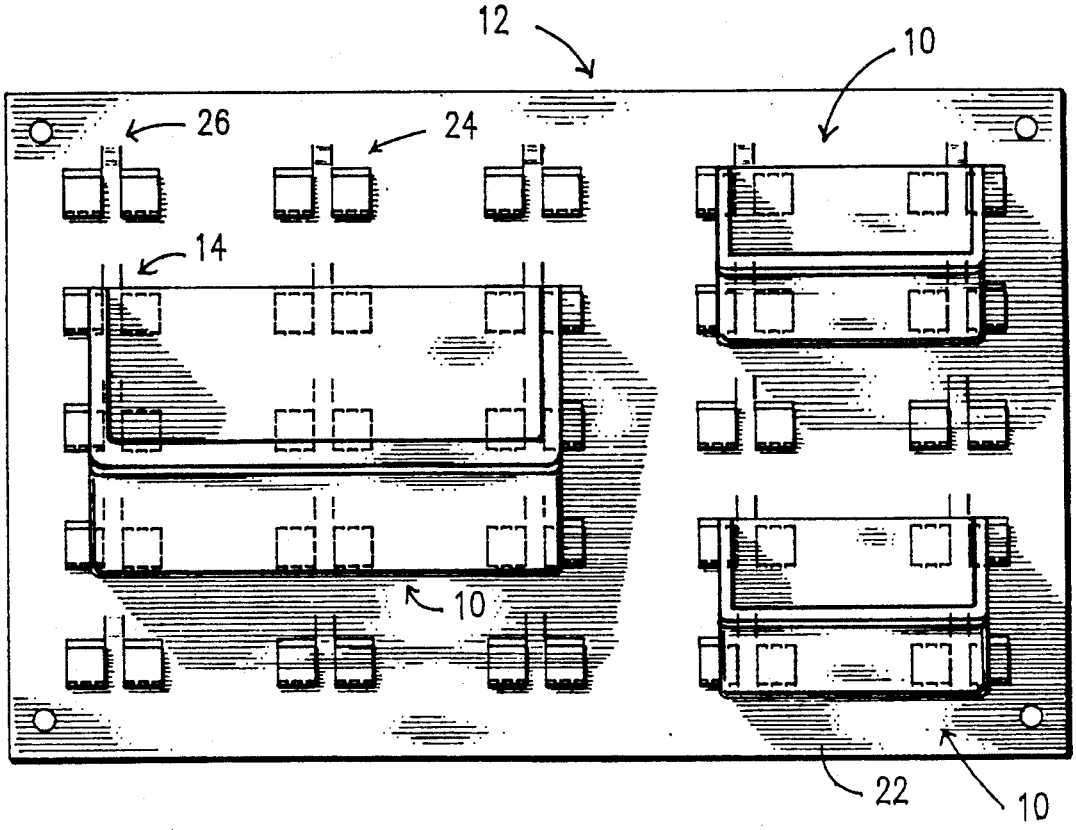
FIG. 1 is a front view of the bin lock system with a plurality of storage bins detachably mounted on the storage panel.
Figure 2:
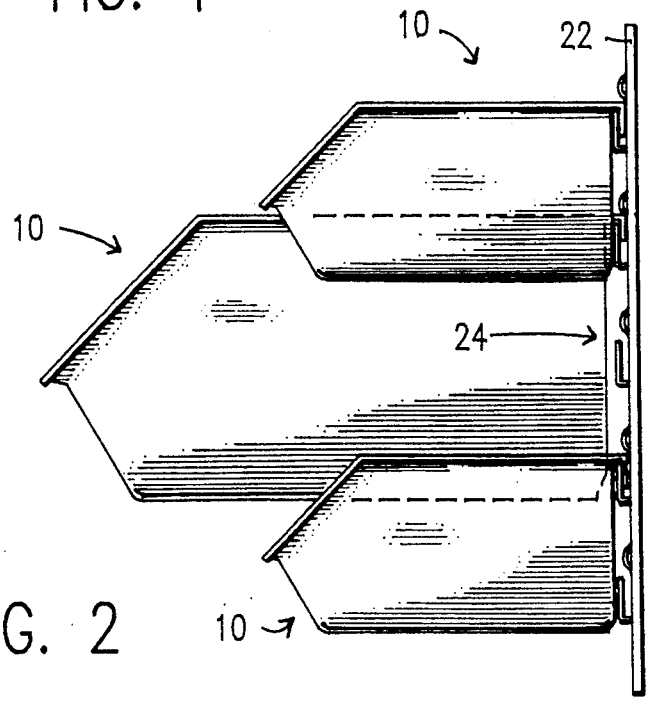
FIG. 2 is a side view of the bin lock system with a plurality of storage bins detachably mounted on the storage panel.

As best shown in FIGS. 1 and 2, the present invention relates to a bin lock system to detachably mount a plurality of storage bins each generally indicated as 10 on a storage panel generally indicated as 12.

Figure 3:
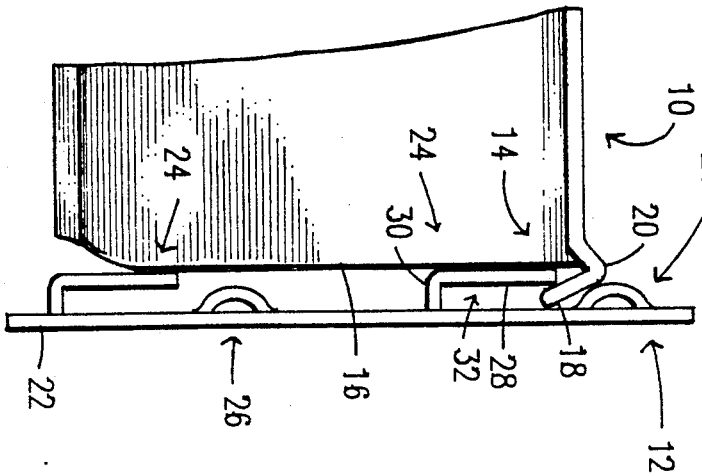
FIG. 3 is a detail side view of a storage bin partially mounted on the storage panel.
Figure 4:
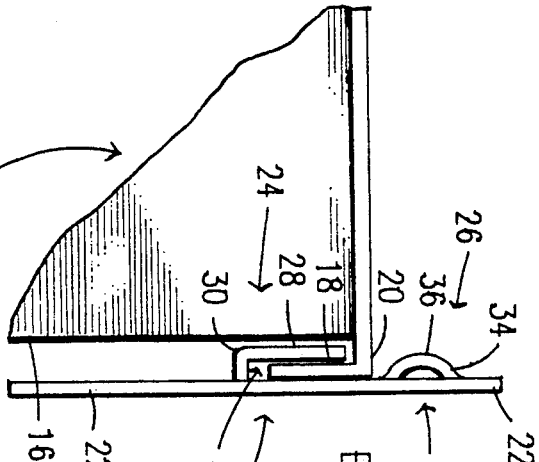
FIG. 4 is a detail side view of a storage bin detachably mounted on the storage panel.
Figure 5:
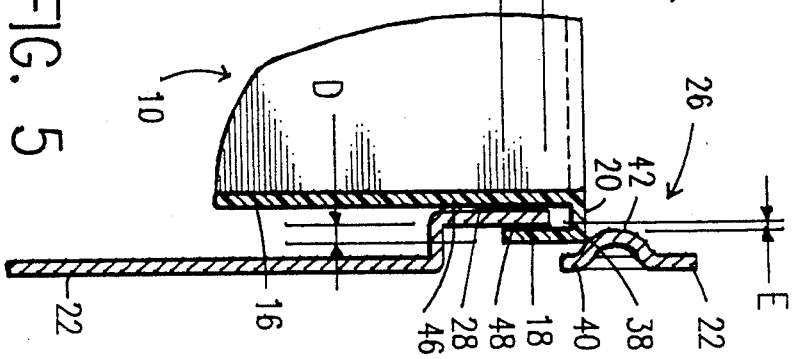
FIG. 5 is a partial detail cross-section side view of a storage bin in the uppermost position detachably mounted on the storage panel.

As best shown in FIGS. 3 through 5, each storage bin 10 includes a flexible attachment member generally indicated as 14 extending outwardly from the rear wall 16 thereof. Each flexible attachment member 14 comprises a substantially L-shaped flexible element including a substantially vertical attachment element 18 held in spaced relationship relative to the rear wall 16 by a substantially horizontal spacer 20.

As best shown in FIGS. 1, 3 and 4, the storage panel 12 comprises a substantially flat storage panel member 22 having a plurality of pairs of bin receiving members each generally indicated as 24 and a corresponding plurality of bin retaining members generally indicated as 26 formed thereon. As best shown in FIGS. 3 through 5, each bin receiving member 24 comprises a substantially vertical receiving element 28 held in spaced relationship relative to the substantially flat storage panel member 22 by a substantially horizontal spacer 30 to cooperatively form a retainer groove 32 therebetween to receive at least a portion of the flexible attachment member 14 therein as described more fully hereinafter.

As best shown in FIGS. 3 through 5, each bin retaining member 26 comprises a convex bin retaining element including an upper and lower camming surface indicated as 34 and 36 respectively and a line of contact 38 formed on the mid portion of the lower camming surface 36 between the intersection 40 of the bin retaining member 26 and the substantially flat storage panel member 22 and the apex 42 of the convex bin retaining element to secure the storage bin 10 to the storage panel 12 as described morefully hereinafter. As best shown in FIG. 1, each bin retaining member 26 is disposed above and equal distance from the corresponding pair of bin receiving members 24.

As best shown in FIG. 5, the vertical distance A between the line of contact 38 and the tip or upper surface 44 of the substantially vertical receiving element 28 is less than the length B of the substantially vertical attachment element 18 such that the lower portion C thereof remains disposed within the retainer groove 32 even when the storage bin 10 is in the uppermost position. Preferably the length B is at least twice the verical distance A. In addition, the width D of the substantially vertical attachment element 18 is greater than the horizontal distance E between the inside surface 46 of the substantially vertical receiving element 28 and the apex of the bin retaining member 26 such that the substantially vertical attachment element 18 engages the line of contact 38 when the storage bin 10 is in the uppermost position.

In use, the substantially vertical attachment element 18 is flexed between a pair of bin receiving members 24 and the corresponding bin retainer member 26 (FIG. 3) such that the substantially vertical attachment element 18 is disposed within the retainer groove 32 (FIG. 4). As previously described, movement of the storage bin 10 relative to the storage panel 12 is limited by the engagement of flexible attachment member 14 and the bin retaining member 26 to retain the substantially vertical attachment element 18 within the retainer groove 32 (FIG. 5) to detachably secure the storage bin 10 on the storage panel 12. The storage bin 10 may be removed from the storage panel 12 by flexing the substantially vertical attachment element 18 and lifting the storage bin 10 upwardly relative to the storage panel 12 removing the substantially vertical attachment element 18 from the retainer groove 32.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A bin lock system including a storage panel to detachably mount a plurality of storage bins thereon, each of said plurality of storage bins includes a rear wall having a corresponding flexible attachment member affixed thereto and said storage panel includes a plurality of bin receiving members and bin retaining members disposed in spaced relationship relative to each other such that when at least a portion of said flexible attachment member is mounted on at least one of said plurality of bin receiving members, each said bin retaining member is disposed to selectively engage one of said plurality of storage bins to secure said storage bin on said storage panel, each said flexible attachment member comprising a corresponding attachment element disposed in spaced relationship relative to said corresponding rear wall of each of said plurality of storage bins by a corresponding spacer and said bin receiving member comprises a receiving element disposed in spaced relationship relative to said storage panel by a corresponding spacer to cooperatively form a retainer groove therebetween to receive at least a portion of said attachment element therein and each said bin retaining member comprising a corresponding bin retaining element including a lower inclined camming surface having a corresponding line of contact formed thereon to selectively engage said flexible attachment members when each of said storage bins is in the uppermost position to secure each of said plurality of storage bins laterally and vertically on the storage panel whereby each of said plurality of storage bins is mounted on and removed from to said corresponding bin receiving member and said corresponding bin retaining member by vertical movement therebetween.

2. The bin lock system of claim 1 wherein said flexible attachment member comprises an attachment element held in spaced relationship relative to the rear wall of said storage bin by a spacer and said bin receiving member comprises a receiving element held in spaced relationship relative to said storage panel by a spacer to cooperatively form a retainer groove therebetween to receive at least a portion of said attachment element therein.

3. The bin lock system of claim 2 wherein said bin retaining member comprises a bin retaining element including a lower inclined camming surface having a line of contact formed thereon to selectively engage said flexible attachment member when said storage bin is in the uppermost position secure said storage bin on said storage panel.

4. The bin lock system of claim 1 wherein said line of contact is formed between the intersection of said bin retaining member and said storage panel and the apex of said lower inclined camming surface.

5. The bin lock system of claim 4 wherein the vertical distance between said line of contact and the upper surface of said receiving element is less than the length of said attachment element such that said attachment element engages said line of contact when said storage bin is in the uppermost position to retain the lower portion of said attachment element within said retainer groove.

6. The bin lock system of claim 5 wherein the width of said attachment element is greater than the horizontal distance between the inside surface of said receiving element and the apex of said bin retaining member such that said attachment element engages said line of contact when said storage bin is in the uppermost position to retain the lower portion of said attachment element within said retainer groove.

7. The bin lock system of claim 5 wherein the length of said attachment element is at least twice the distance between said line of contact and the upper surface of said receiving element.

8. The bin lock system of claim 4 wherein the width of said attachment element is greater than the horizontal distance between the inside surface of said receiving element and the apex of said bin retaining member such that said attachment element engages said line of contact when said storage bin is in the uppermost position to retain the lower portion of said attachment element within said retainer groove.

9. The bin lock system of claim 1 wherein said bin retaining member comprises a convex bin retaining element including a lower camming surface having a line of contact formed on the mid portion thereof between the intersection of said bin retaining member and said storage panel member and the apex of said convex bin retaining element.

10. The bin lock system of claim 1 wherein said storage panel includes at least one pair of said receiving members and a corresponding bin retaining member.

11. The bin lock system of claim 10 wherein said corresponding bin retaining member is disposed above and equal distance from said pair of receiving members.

12. The bin lock system of claim 1 wherein each of said plurality of rear walls being disposed adjacent said storage panel and substantially parallel thereto.

* * * * *